United States Patent [19]

Carduck et al.

[11] 4,175,050

[45] Nov. 20, 1979

[54] SHAPED WASHING AGENTS HAVING A MOSAIC-LIKE STRUCTURE AND PROCESS

[75] Inventors: Franz-Josef Carduck, Haan am Rhld; Dietrich Klötzer, Düsseldorf; Werner Schneider, Krefeld; Willi Wüst, Ratingen-Hosel, all of Fed. Rep. of Germany

[73] Assignee: Henkel Kommanditgesellschaft auf Aktien (Henkel KgaA), Dusseldorf-Holthausen, Fed. Rep. of Germany

[21] Appl. No.: 842,802

[22] Filed: Oct. 17, 1977

[30] Foreign Application Priority Data

Oct. 21, 1976 [DE] Fed. Rep. of Germany ..... 2647447

[51] Int. Cl.[2] ..... C11D 13/18; C11D 13/14

[52] U.S. Cl. ..... 252/91; 252/111; 252/134; 252/174; 252/370; 264/73; 264/77; 264/102; 264/109; 264/245

[58] Field of Search ..... 252/111, 134, 174, 370, 252/91; 264/77, 102, 109, 245, 73

[56] References Cited

U.S. PATENT DOCUMENTS 3,746,647 7/1973 Peloquin ..... 252/91

FOREIGN PATENT DOCUMENTS 1401852 7/1964 France ..... 252/134

*Primary Examiner*—Mayer Weinblatt
*Attorney, Agent, or Firm*—Hammond & Littell

[57] ABSTRACT

A shaped washing agent based on colored soaps and/or synthetic detergents comprising a plurality of individual colored particles of soap and/or synthetic detergent having a size range of 1 to 20 millimeters, so distributed that they adjoin one another with sharply defined boundries, said boundries being substantially free of occluded gas, to give at least a mosaic-like appearance to at least part of the surface of said shaped washing agent; and the process of producing said shaped washing agent by compressing the individual particles in the substantial absence of gas between said particles.

14 Claims, 4 Drawing Figures

SHAPED WASHING AGENTS HAVING A MOSAIC-LIKE STRUCTURE AND PROCESS

BACKGROUND OF THE INVENTION

Multicolored cakes or bars of soap having a striped, marbled or speckled appearance are known. Such multicolored soap bars afford the possibility of achieving an attractive appearance and characteristic distinguishing features by specific coloring and/or colored patterns.

Multicolored soap bars have been produced by mixing liquid soaps of differing colors, by supplying pigments or dyes during the production of the soap bars in an extruder, by incorporating colored particulate material into a soap basic mass before extruding, by pressing soap particles of differing colors or by pressing solid soaps of differing colors in the form of pieces of soap.

With these methods for the manufacture of multicolored soap bars, the colored constituents of the soap must be mixed together in accurately maintained proportions to achieve the multicolored effect, while if mixing of the colored constituents is too thorough, a continuously colored product results, whereas inadequate mixing results in a soap tablet with an unattractive exterior. The way in which the color-producing components are mixed with the basic mass before extrusion is decisive for the resultant colored soap bars. The differently colored constituents of the soap must, of course, be clearly distinguishable. They must, however, also be so firmly bonded together so that the properties of the whole soap bar in use are not adversely affected. This means that the differently colored constituents must not come apart or become fissured, rough or uneven.

In bars of soap made by pressing solid soaps or soap powders, special difficulties arise in regard to their properties in use.

U.S. Pat. No. 3,999,921 and U.S. patent application Ser. No. 695,455, filed June 14, 1976, now U.S. Pat. No. 4,094,946, describe several methods of obtaining colored soap bars by extrusion of two differently colored strands from one extruder and mixing the same and U.S. Pat. No. 4,036,775 describes a method of obtaining a mottled or marbled cake or bar from a piece of extruded rope having axially aligned sections of different colors.

Variegated soap bars and their production are disclosed in U.S. Pat. Nos. 3,923,438; 3,823,215 and 3,779,676. Solid stripped soap bars and their production are disclosed in U.S. Pat. Nos. 3,884,605 and 3,398,219. Finally extrusions of one colored soap strand surrounding different colored cylinders axially aligned therein is described in Japanese Pat. No. 47-3618 (252/371).

OBJECTS OF THE INVENTION

An object of the present invention is the obtaining of a shaped washing agent based on colored soaps and/or synthetic detergents comprising a plurality of individual colored particles of soap and/or synthetic detergent having a size range of 1 to 20 millimeters, so distributed that they adjoin one another with sharply defined boundaries, said boundaries being substantially free of occluded gas, to give at least a mosaic-like appearance to at least part of the surface of said shaped washing agent.

Another object of the present invention is the development of a process for the production of a shaped washing agent based on colored soaps and/or synthetic detergents comprising a plurality of individual colored particles of soap and/or synthetic detergent having a size range of 1 to 20 millimeters, so distributed that they adjoin one another with sharply defined boundries, said boundries being substantially free of occluded gas, to give at least a mosaic-like appearance to at least part of the surface of said shaped washing agent which comprises the steps of compressing a plurality of individual colored particles of soap and/or synthetic detergent having a size range of 1 to 20 millimeters under a pressure of from 60 to 450 bar in the substantial absence of gas between said particles, to form a shaped article and recovering said shaped washing agent.

These and other objects of the invention will become more apparent as the description thereof proceeds.

THE DRAWINGS

DESCRIPTION OF THE INVENTION

Figure 1:
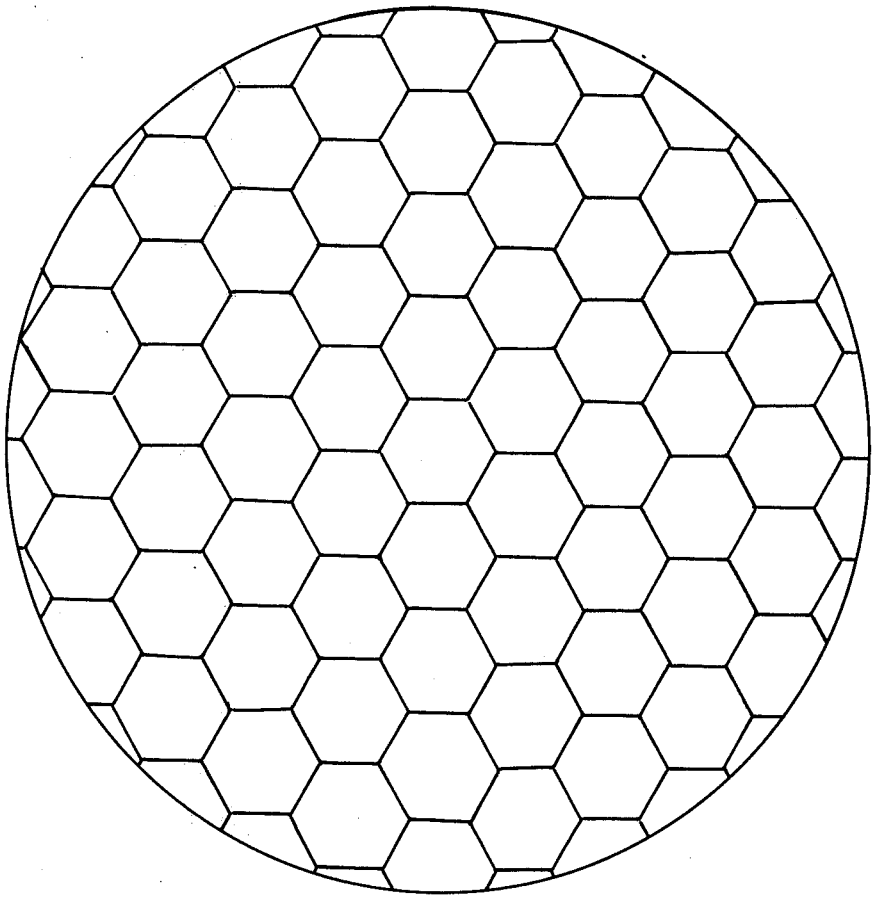
FIG. 1 shows an enlarged surface of a soap shaped washing agent of the invention comprising a mosaic-like surface of hexagons.

According to one aspect of the present invention there is provided a cleaning agent in piece form, comprising colored soap particles so distributed that they adjoin one another with sharply defined boundaries to give at least a part of the surface of the cleaning agent a mosaic-like appearance with the sides of the soap particles forming substantially polygon sides. The number of sides of the polygons can vary from a few to very much in number. In the limiting case—also encompassed by the invention—round or lens-like shapes including circular shapes may therefore also be present, or in other words the colored portions of soap can adopt any forms from irregular granulate to spherical or lens-shapes. More particularly, the present invention relates to a shaped washing agent based on colored soaps and/or synthetic detergents comprising a plurality of individual colored particles of soap and/or synthetic detergent having a size range of 1 to 20 millimeters, so distributed that they adjoin one another with sharply defined boundaries, said boundaries being substantially free of occluded gas, to give at least a mosaic-like apparance to at least part of the surface of said shaped washing agent.

Here and in the following text, soap is to be understood to mean both the usual fatty acid soaps and also synthetic soap materials or tensides.

The process of manufacture of the cleaning agent cake or bar, especially of soap bars from highly dried and colored soap particles consists in principal in that the soap particles are compressed under high pressure after or during the evacuation of the mold containing the pourable particles, granulates or pellets.

More particularly, the present invention also relates to a process for the production of a shaped washing agent based on colored soaps and/or synthetic detergents comprising a plurality of individual colored particles of soap and/or synthetic detergent hving a size range of 1 to 20 millimeters, so distributed that they adjoin one another with sharply defined boundaries, said boundaries being substantially free of occluded gas, to give at least a mosaic-like appearance to at least part of the surface of said shaped washing agent which comprises the steps of compressing a plurality of individual colored particles of soap and/or synthetic detergent having a size range of 1 to 20 millimeters under a pressure of from 60 to 450 bar in the substantial absence of gas between said particles, to form a shaped article and recovering said shaped washing agent.

For the manufacture of cleaning agent cakes or bars with the mosaic-like appearance it is preferred that (a) a mixture of dyed granular or spherical soap particles which are in the size range of 1 to 20 mm preferably from 3 to 15 mm is prepared, (b) the mixture is filled into a bar press which consists of a matrix, upper or lower dies and an evacuation device designed to maintain a vacuum and (c) a vacuum of less than 100 torr is created in the filled bar press and simultaneously the mixture is compressed under a pressure of 60 to 450 bar, preferably 120 to 150 bar.

The soap bars produced by the process of the invention exhibit a unique mosaic-like structure which is characterized by sharply defined polygons (including round shapes). By means of such soap bars with mosaic-like appearance particularly eye-catching aesthetic effects are created. Particularly emphasized in this connection are color effects that give a so-called flowery appearance.

The possibilities of variation of the mosaic-like appearance are almost unlimited. Tablets of soap can be made of colored particles of soap of the same color. Surprisingly, such tablets do not exhibit uniform coloring but produce especially aesthetic effects by the appearance of sharply defined patterns. Likewise, an especially aesthetic effect is produced by soap tablets made from differently colored particles of soap, the differently colored constituents being uniformly distributed in the tablets. The appearance is characterized by differently colored partial regions comprising two or more colors, sharply distinguished one from another.

It is preferable for the soap particles to be in the particle size range of 1 to 20 millimeters. A more preferred range of particle size is 3 to 15 millimeters. Preferably substantially all of the particles are of the same size and vary in an amount of ±1 mm from the average size range.

It is also preferable for the soap particles to have a fatty acid content of 70% to 85% of the entire soap mass, 76% to 80% being especially preferred. The preferred soap particles employed in the present process are those prepared according to commonly-assigned U.S. Pat. No. 4,014,807.

This patent discloses shaped washing agents based on synthetic detergents and/or soaps containing from 1 to 10% by weight, based on the total composition, of a compound supplying resistance to cracking selected from the group consisting of branched-chain alkanols having from 12 to 20 carbon atoms and dioctyl adipate having up to 50% of n-octyl groups. The particles employed are colored and have a reduced water content from the 30% present in kettle soap. As described in the aforesaid patent, these soap particles are based on wash active substances selected from the group consisting of synthetic detergents and soaps consisting essentially of (A) from 54% to 89% by weight of said wash active substances, (B) from 0 to 40% by weight of non-wash active substances customarily incorporated in shaped washing agents, (C) from 10% to 25% water and (D) from 1 to 10% by weight, of a compound supplying resistance to cracking selected from the group consisting of branched-chain alkanols having from 12 to 20 carbon atoms and di-octyl adipate having up to 50% of n-octyl and the remainder iso-octyl.

Embodiments of the present invention will now be more particularly described by way of example with reference to the accompanying drawings in which:

FIG. 1 shows an about 3x enlarged soap tablet surface comprising a mosaic-like surface consisting of hexagonal particles, the hexagonal boundries being straight.

Figure 2:
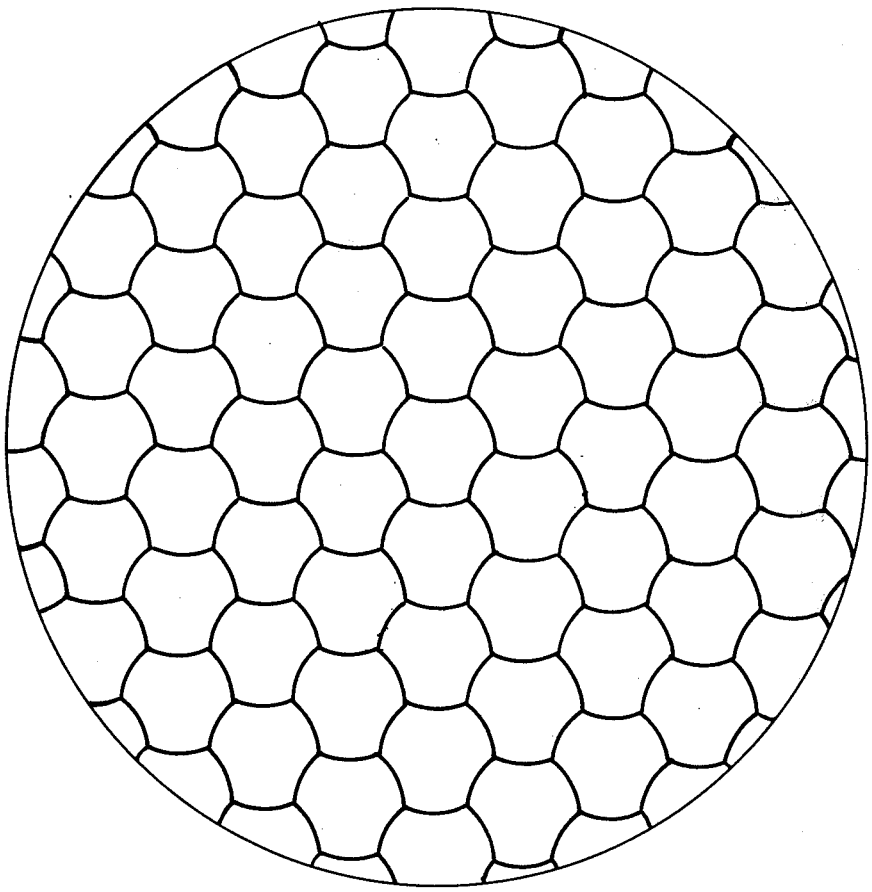
FIG. 2 shows an enlarged surface of a shaped washing agent of the invention with a surface with curved hexagons.
Figure 3:
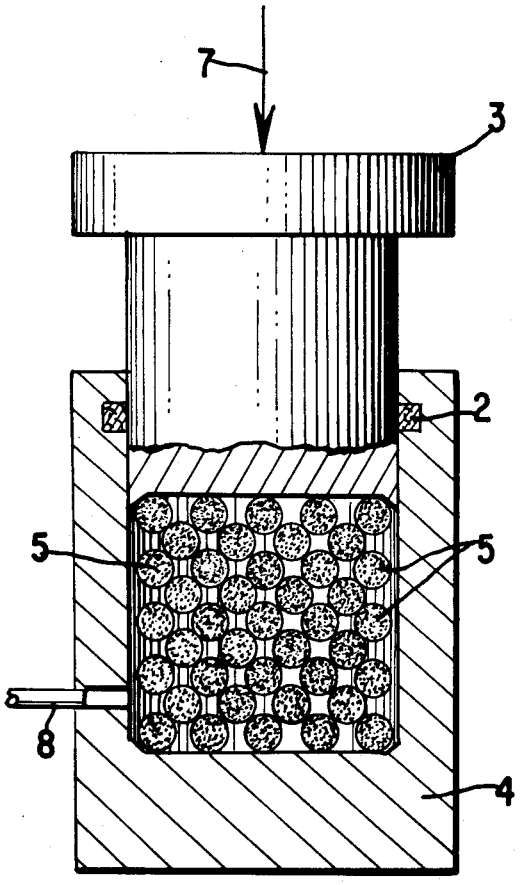
FIG. 3 is a cross-sectional view of a soap press at the start of its compression stroke.
Figure 4:
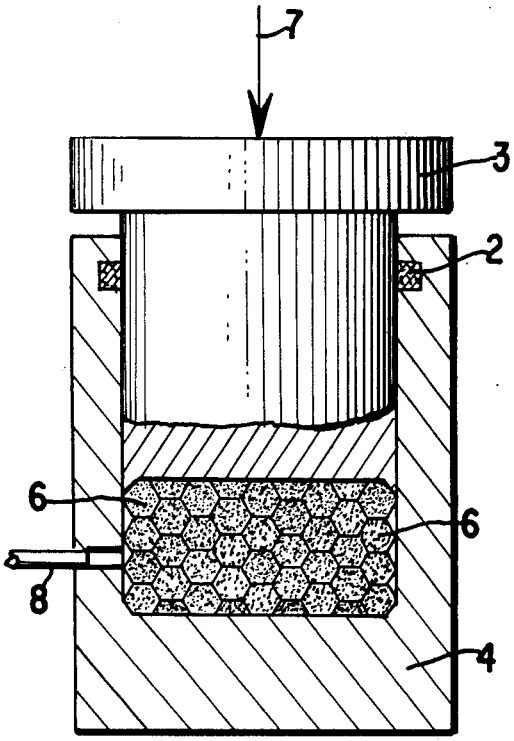
FIG. 4 is a cross-sectional view of a soap press at the termination of its compression stroke.

FIG. 2 shows an about 3x enlarged soap tablet surface with curved hexagonal boundries and FIGS. 3 and 4 show a soap tablet being produced in a press.

Referring to the drawings, the pressure required for the pressing of soap particles e.g. granules or spheres should preferably be 130 bar and the pressing speed between 0.1 and 5 meters/minute. The temperature of the soap particles to be processed should be between 15° C. and 45° C.

To obtain a good bond between the individual soap particles, the air should be removed from the mass of the particles before or during pressing, by applying a vacuum. In this respect, vacuums of less than 5 torr have given the best results.

To avoid susceptibility to cracking, it is also preferable for the soap particles to contain from 1% to 10% by weight of branched-chain aliphatic alcohols comprising 12 to 20 carbon atoms in the molecule, especially isotridecyl alcohol, branched-chain hexadecyl alcohol, from petrochemical production, 2-hexyldecanol, isooctadecyl alcohol, 2-octyl-dodecanol and dioctyl-adipate comprising 50% n-octyl and 50% iso-octyl constituents. To prevent cracking during repeated wetting and drying during use, the soap mass should have an addition particularly of about 4% 2-octyl-dodecanol.

The following Example is illustrative of the practice of the invention without being limitative in any resepct.

EXAMPLE

Referring to FIGS. 3 and 4, a pressing mold is used, in which an upper plunger 3 and a mold 4 are completely sealed by sealing rings 2, so that a vacuum of less than 2 torr can be obtained without difficulty in the empty mold and maintained for a fairly long period.

For the production of the mosaic-like soap cakes, fresh soap particles 5, with a fatty acids soap content of 76% and containing 4% 2-octyl-dodecanol, was used. To ensure that the soap tablet 6 could be satisfactorily removed from the mold 4, the mold 4 was sprayed with a glycerine-water mixture. The average diameter of each soap particle was 5 millimeters, and the temperature of the soap particles was 20° C. After the pressing mold 6 had been filled with the appropriate amount of soap particles 5, the mold was closed by insection of the plunger 3 (See FIG. 3) evacuated by vacuum connector 8 and then compressed at a pressing speed of 1.2 meters/minute by the action of an external force of 6 tonnes (Δ140 bar) in the direction of arrow 7.

To investigate the influence of the evacuation upon the pressing results, the pressing mold and soap material 5 were evacuated to different levels, that is to 760, 20 and <5 torr. The vacuum was measured in the mold by a U-tube monometer (not shown) on the opposite side of a vacuum connection 8. This ensured that the measured vacuum was exactly equal to the vacuum existing in the pile of particles 5.

The tests showed that, with increasing vacuum, the formation of cracks decreases in the wet crack test (WCT) and the use test (GBT). If the pile of soap material was evacuated before compressing to less than 5 torr, then soap tablets without any cracks were obtained (WCT and GBT were zero).

| Test | I | II | III |
|---|---|---|---|
| Torr | 760 | 20 | <5 |
| WCT | 2-3 | 0 | 0 |
| GBT | 2-3 | 1-2 | 0 |

An interesting observation is that soap tablets having WCT=0 and GBT=0 possess absolutely homogenous and smooth surfaces. If, by contrast, the air was removed less effectively, then rough and sometimes highly fissured surfaces result. The surfaces had a matt effect and exhibited a star-shaped, white pattern, the formation of which was most pronounced where the soap materials charged had not been evacuated before compressing. This white pattern appears wherever compressed air is enclosed in the soap layer and can escape out of the outermost layer of soap in a quasi-explosive manner after the applied pressing force has been removed.

1. Wet Crack Test

This method imitates the storing of a soap bar in a wet soap dish and allows quick results regarding its cracking tendency.

Procedure:

From the surface of the bar about 5 mm are planed off until the surface is completely smooth. The bar is then placed for 30 minutes in a dish filled with tap water, the water level 1 cm above the bar. After removing the bar the water is allowed to flow down for a while. After 24 hours the cracking is scored.

0=no cracking
1=slight cracking
2=evident cracking
3=severe cracking

2. Use Test

Each panelist uses at home two bars, one without a special soap holder, direct on the basin, the other on an artificial soap holder with good drying character. 2-3 weeks after use the bars are judged and scored. (Same scoring scheme as in the Wet Crack Test).

A substantial advantage of the method above described of producing a cleaning agent is that it can be carried out without recycling of soap material ordinarily required during pressing of the soap tablets. This advantage becomes especially apparent when compared with the production of bars of soap from a continuous strand of soap. With the extrusion presses utilized for the latter method, up to 30% recycling must be expected.

The preceding specific embodiments are illustrative of the practice of the invention. It is to be understood however that other expedients known to those skilled in the art or disclosed herein, may be employed without departing from the spirit of the invention or the scope of the appended claims.

We claim:

1. A process for the production of a soap bar shaped washing agent based on colored soaps and/or synthetic detergents comprising a plurality of individual colored particles of wash active substances selected from the group consisting of soap and synthetic detergent having a size range of 1 to 20 millimeters, so distributed that they adjoin one another with sharply defined boundaries, said boundaries being substantially free of occluded gas, to give a mosaic-like appearance to at least part of the surface of said shaped washing agent which comprises the steps of compressing a plurality of individual colored particles of wash active substances selected from the group consisting of soap and synthetic detergent having a size range of 1 to 20 millimeters at a temperature of from 15° C. to 45° C., at a press rate of from 0.1 to 5 meters per minute under a pressure of from 60 to 450 bar in the substantial absence of gas between said particles at a vacuum of less than 100 torr, to form a soap bar shaped article and recovering said soap bar shaped washing agent.

2. The process of claim 1 wherein said individual colored particles all have the same color.

3. The process of claim 1 wherein said individually colored particles have at least two colors.

4. The process of claim 1 wherein said individual colored particles are soap and have a fatty acid content of from 70% to 85% by weight.

5. The process of claim 1 wherein said individual colored particles based on wash active substances selected from the group consisting of soap and synthetic detergent consist essentially of (A) from 54% to 89% by weight of said wash active substances, (B) from 0 to 40% by weight of non-wash active substances customarily incorporated in shaped washing agents, (C) from 10% to 25% water and (D) from 1 to 10% by weight, of a compound supplying resistance to cracking selected from the group consisting of branched-chain alkanols having from 12 to 20 carbon atoms and di-octyl adipate having up to 50% of n-octyl and the remainder iso-octyl.

6. The process of claim 1 wherein said compression pressure is from 120 to 150 bar.

7. The process of claim 1 wherein said compression pressure is from 130 to 140 bar.

8. The process of claim 1 wherein a vacuum of less than 5 torr supplies the substantial absence of gas between said particles.

9. The process of claim 1 wherein said pressing rate is 1.2 meters per minute.

10. The shaped washing agent produced by the process of claim 1.

11. The process of claim 1 wherein said individual colored particles all have a size range of ±1 mm from the average size range.

12. The process of claim 11 wherein said individual colored particles have an average particle size in the range of from 3 to 15 millimeters.

13. The process of claim 11 wherein said individual colored particles have a particle size of 5±1 millimeters

14. A process for the production of a soap bar shaped washing agent based on colored soaps and/or synthetic detergents comprising a plurality of individual colored particles of wash active substances selected from the group consisting of soap and synthetic detergent having a size range of 1 to 20 millimeters, so distributed that they adjoin one another with sharply defined boundaries, said boundaries being substantially free of occluded gas, to give a mosaic-like appearance to at least part of the surface of said shaped washing agent which comprises the steps of compressing a plurality of individual particles based on wash active substances selected from the group consisting of soap and synthetic detergent, said particles consisting essentially of (A) from 54% to 89% by weight of said wash active substances, (B) from 0 to 40% by weight of non-wash active substances customarily incorporated in shaped washing agents, (C) from 10% to 25% water and (D) from 1 to 10% by weight of a compound supplying resistance to cracking selected from the group consisting of branched-chain alkanols having from 12 to 20 carbon atoms and di-octyl adipate having up to 50% of n-octyl and the remainder iso-octyl, having a particle size range of from 3 to 15 mm with an average deviation of ±1 mm, at a temperature of from 15° C. to 45° C., at a press rate of from 0.1 to 5 meters per minute under a pressure of from 120 to 150 bar, in the substantial absence of gas between said particles at a vacuum of less than 5 torr, to form a soap bar shaped article and recovering said soap bar shaped washing agent.

* * * * *